US006792897B2

(12) United States Patent
Higuchi et al.

(10) Patent No.: US 6,792,897 B2
(45) Date of Patent: Sep. 21, 2004

(54) SOUNDPROOFED ENGINE GENERATOR

(75) Inventors: Masaaki Higuchi, Tokyo (JP); Shinichi Okazaki, Tokyo (JP)

(73) Assignee: Fuji Jukogyo Kabushiki Kaisha, Tokyo (JP)

( * ) Notice: Subject to any disclaimer, the term of this patent is extended or adjusted under 35 U.S.C. 154(b) by 0 days.

(21) Appl. No.: 10/266,469

(22) Filed: Oct. 8, 2002

(65) Prior Publication Data

US 2003/0070651 A1 Apr. 17, 2003

(30) Foreign Application Priority Data

Oct. 11, 2001 (JP) ..... P. 2001-314318

(51) Int. Cl.[7] ..... F02B 63/00
(52) U.S. Cl. ..... 123/2; 290/1 A
(58) Field of Search ..... 123/3, 198 E, 123/2; 290/1 A

(56) References Cited

U.S. PATENT DOCUMENTS 6,492,740 B2 * 12/2002 Suzuki ..... 290/1 A

FOREIGN PATENT DOCUMENTS

JP 11-200861 7/1999 ..... F01P/5/06

* cited by examiner

*Primary Examiner*—Tony M. Argenbright
*Assistant Examiner*—Katrina B. Harris
(74) *Attorney, Agent, or Firm*—Darby & Darby

(57) ABSTRACT

In each of the soundproofed engine generators, the position at which the power generator body is coupled to the crank shaft is located at the end part on the crank shaft. In the soundproofed engine generator of the inverter type, the inverter unit is opposed to the power generator body at a position just upstream of the power generator body. Accordingly, when the inverter unit and the power generator body are removed, a continuous, long and large space for receiving the power generator body can be secured within the soundproof cover.

19 Claims, 8 Drawing Sheets

SOUNDPROOFED ENGINE GENERATOR

BACKGROUND OF THE INVENTION

1. Field of the Invention

The present invention relates to an engine generator of the soundproof type in which an engine and a power generator are covered with a soundproof cover.

2. Description of the Related Art

In the field of the engine generators, to reduce generator operating sounds, many soundproofed engine generators have been proposed in which the engine and the power generator are housed within the soundproof cover. For example, Japanese Patent Laid-Open No. 11-200861 discloses a soundproofed engine generator. In the engine generator, an inverter controlled power generator, a cooling fan, and a recoil starter are coupled onto a crank shaft of the engine in this order from the base end thereof. The generator and the cooling fan are accommodated in the fan cover. An engine generator in which the recoil starter is housed in a recoil starter cap coupled to the fan cover, is accommodated in a soundproof cover (case).

In some types of engine generators, the power generator of an automatic voltage regulator (AVR) is employed in place of the power generator of the inverter type. To satisfy various demands by users, it is preferable that the manufacture can provide two types of soundproofed engine generators of the inverter type and the AVR type.

To enable the power generator of the AVR type to have a power generating ability comparable with that of the power generator of the inverter type, however, it is necessary to elongate the axial length of the power generator. To satisfy such a requirement in the technique disclosed in the publication of Japanese Patent Laid-Open No. 11-200861, if attempt is made to construct the soundproofed engine generator using the power generator of the AVR instead of the power generator of the inverter type, the configurations of the fan cover, recoil starter and the like must be greatly changed and altered. As a result, it is necessary to greatly alter the soundproof cover or the layout of parts within the soundproof cover.

SUMMARY OF THE INVENTION

Accordingly, an object of the present invention is to provide a soundproofed engine generator which enables a soundproofed engine generator of the inverter type or a soundproofed engine generator of the AVR type to selectively be constructed without great altering of the generator construction.

To achieve the above object, there is provided a soundproofed engine generator comprising an engine generator in which a power generator body of an inverter type or a power generator body of an automatic voltage regulating type is selectively coupled to a crank shaft of an engine at a coupling position located at an end part on the crank shaft; and a soundproof cover having a power generator accommodating space accommodating the engine generator and an inverter unit.

In the soundproofed engine generator, the soundproofed engine generator, further comprising: a seat for supporting the engine generator, wherein the seat attaches selectively a power generator support part for the inverter type or a power generator support part for the automatic regulator type thereon.

DETAILED DESCRIPTION OF THE PREFERRED EMBODIMENTS

Figure 1:
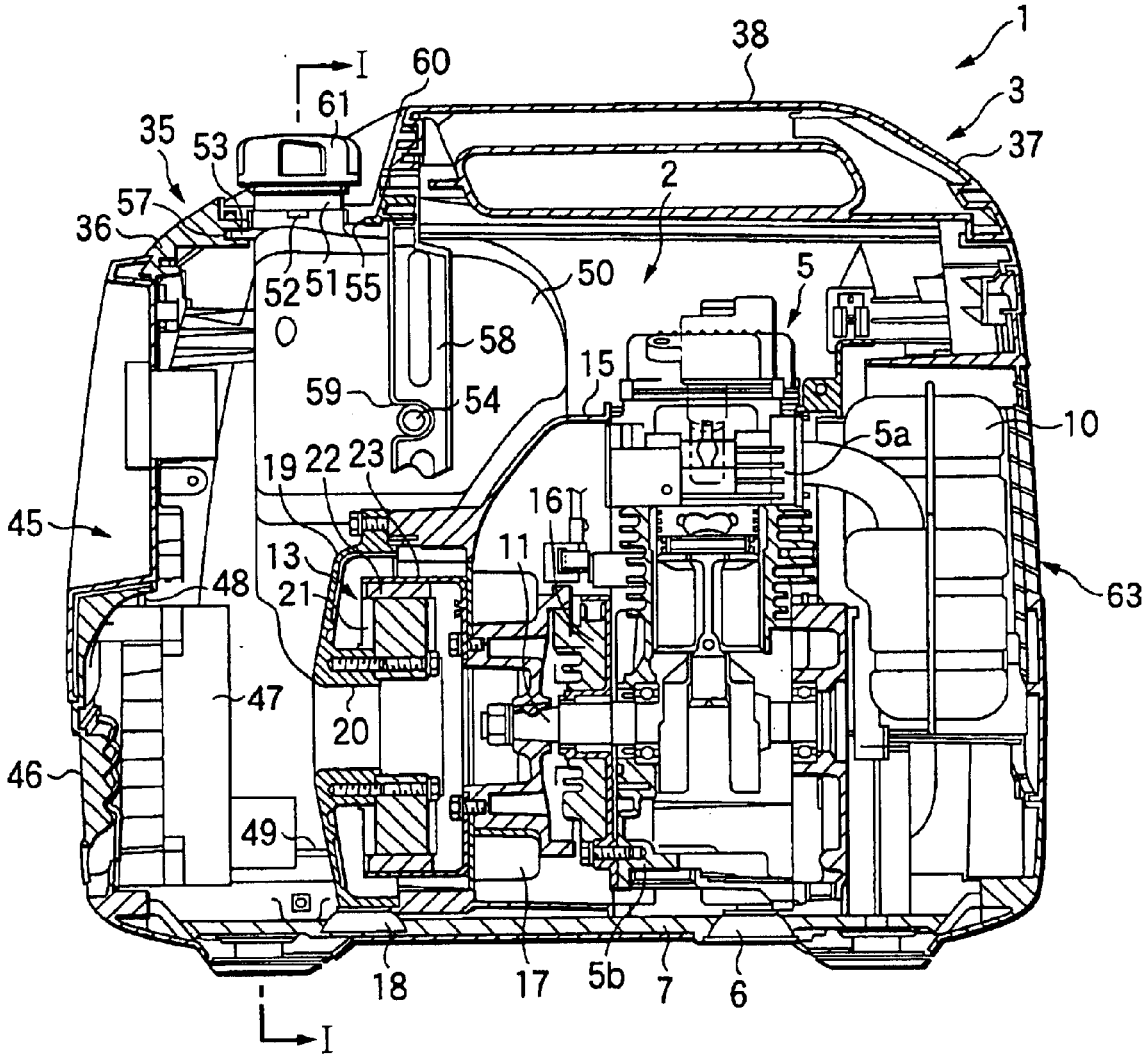
FIG. 1 is a longitudinal sectional view showing a soundproofed engine generator of the inverter type when viewed from the right side.
Figure 2:
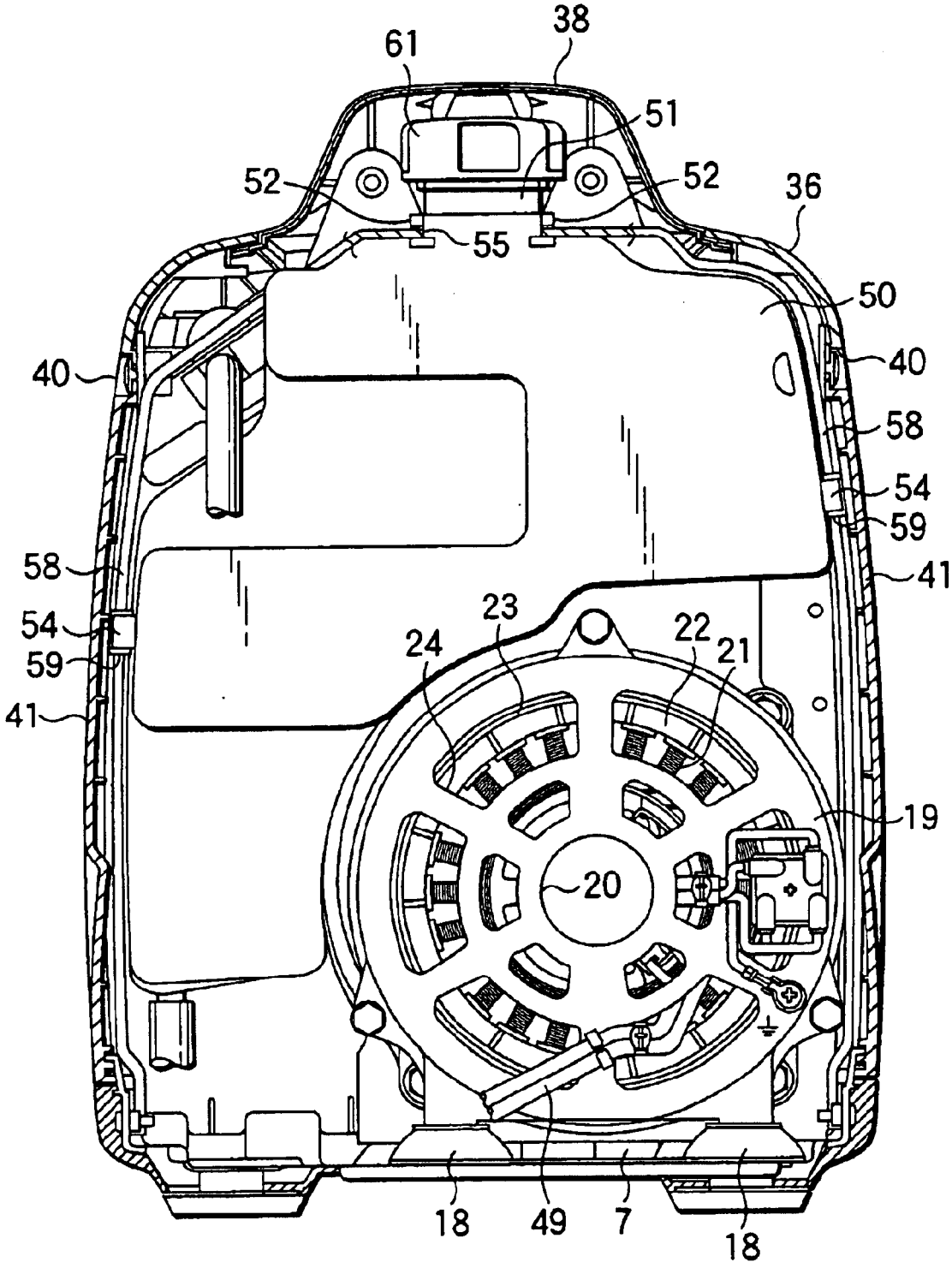
FIG. 2 is a cross sectional view taken on line I—I in FIG. 1.
Figure 3:
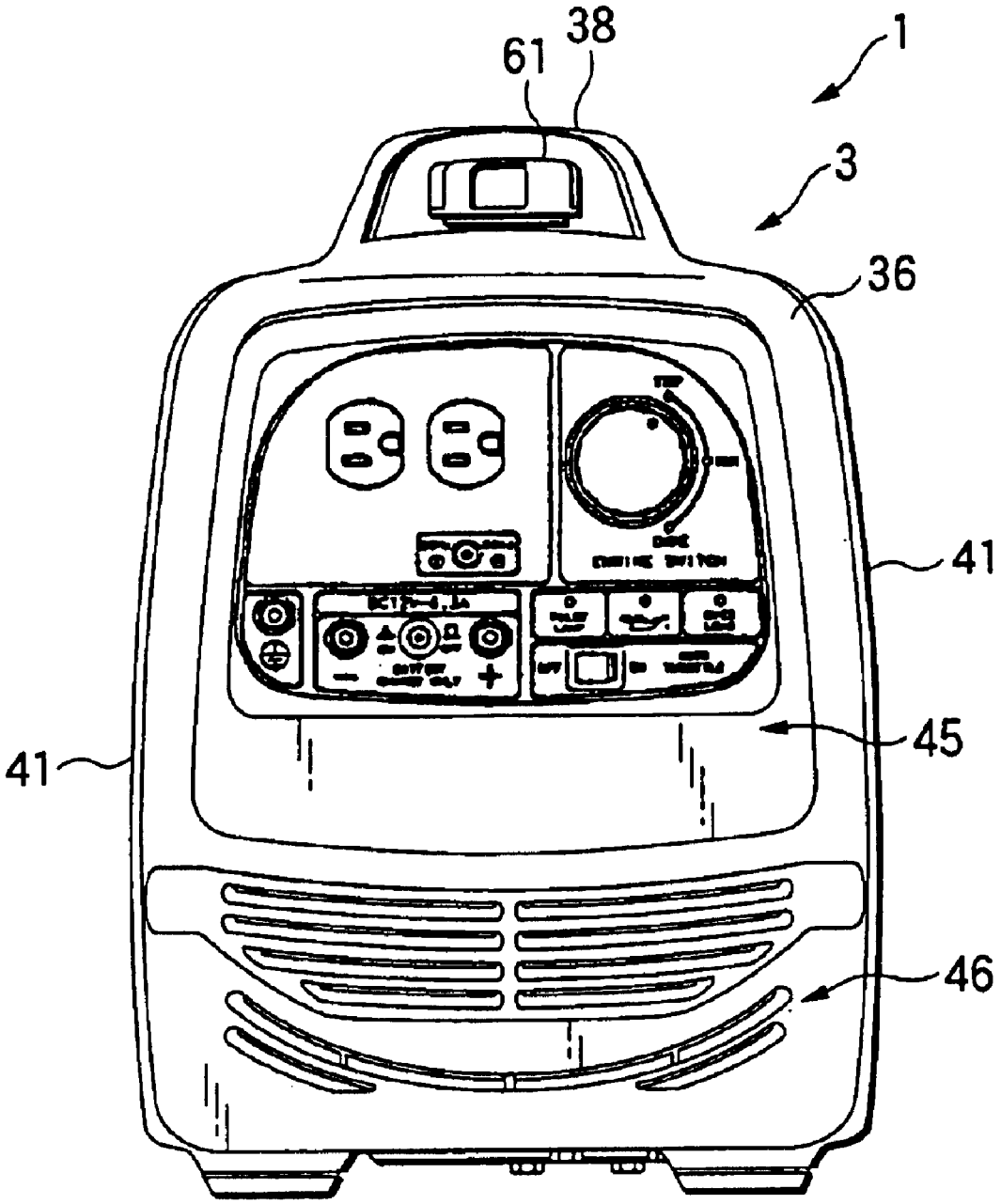
FIG. 3 is a front view showing an external appearance of the soundproofed engine generator.
Figure 4:
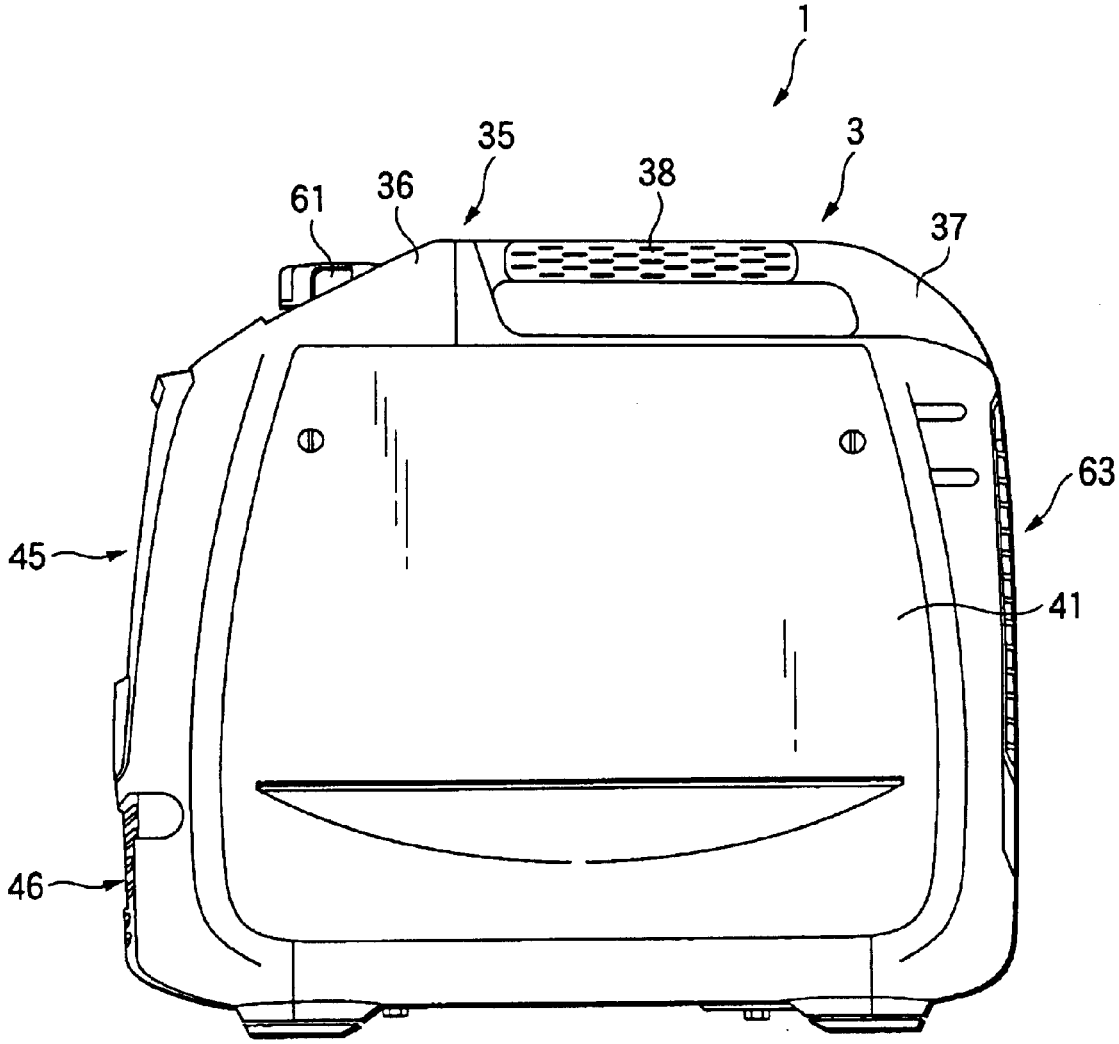
FIG. 4 is a right side view showing an external appearance of the soundproofed engine generator.
Figure 5:
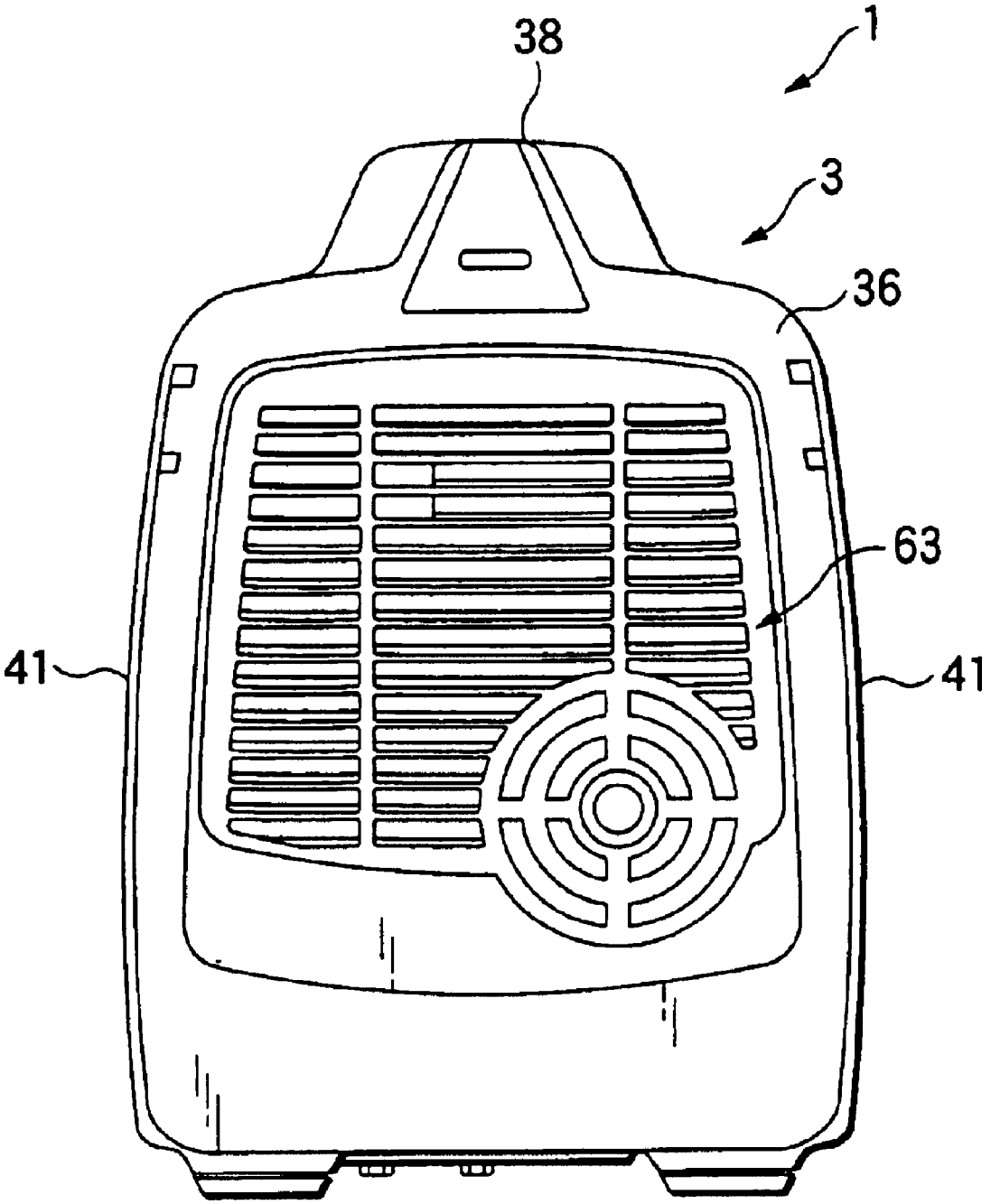
FIG. 5 is a rear view showing an external appearance of the soundproofed engine generator.
Figure 6:
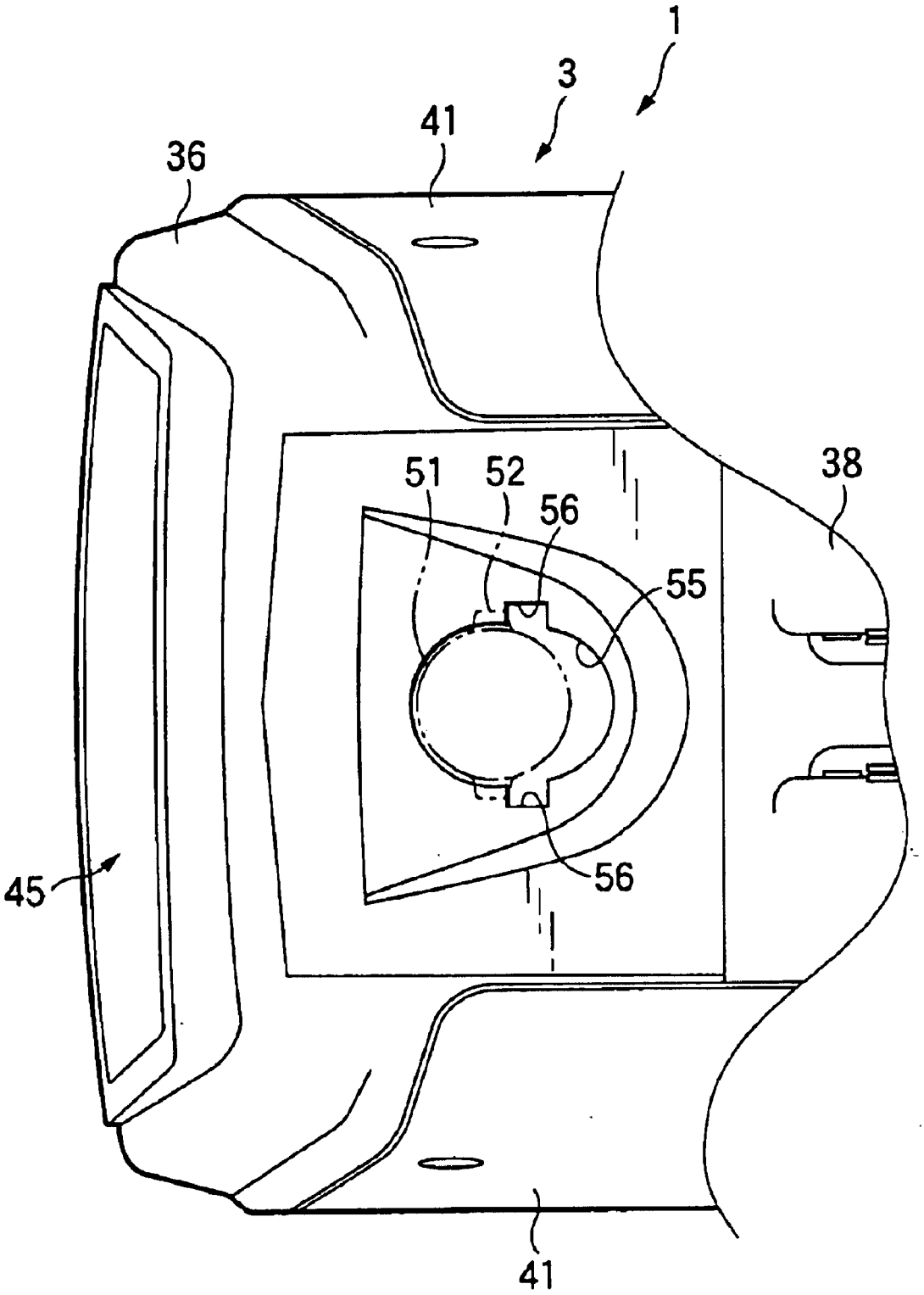
FIG. 6 is a top view showing a structure including a fuel tank mounting part in the soundproofed engine generator.
Figure 7:
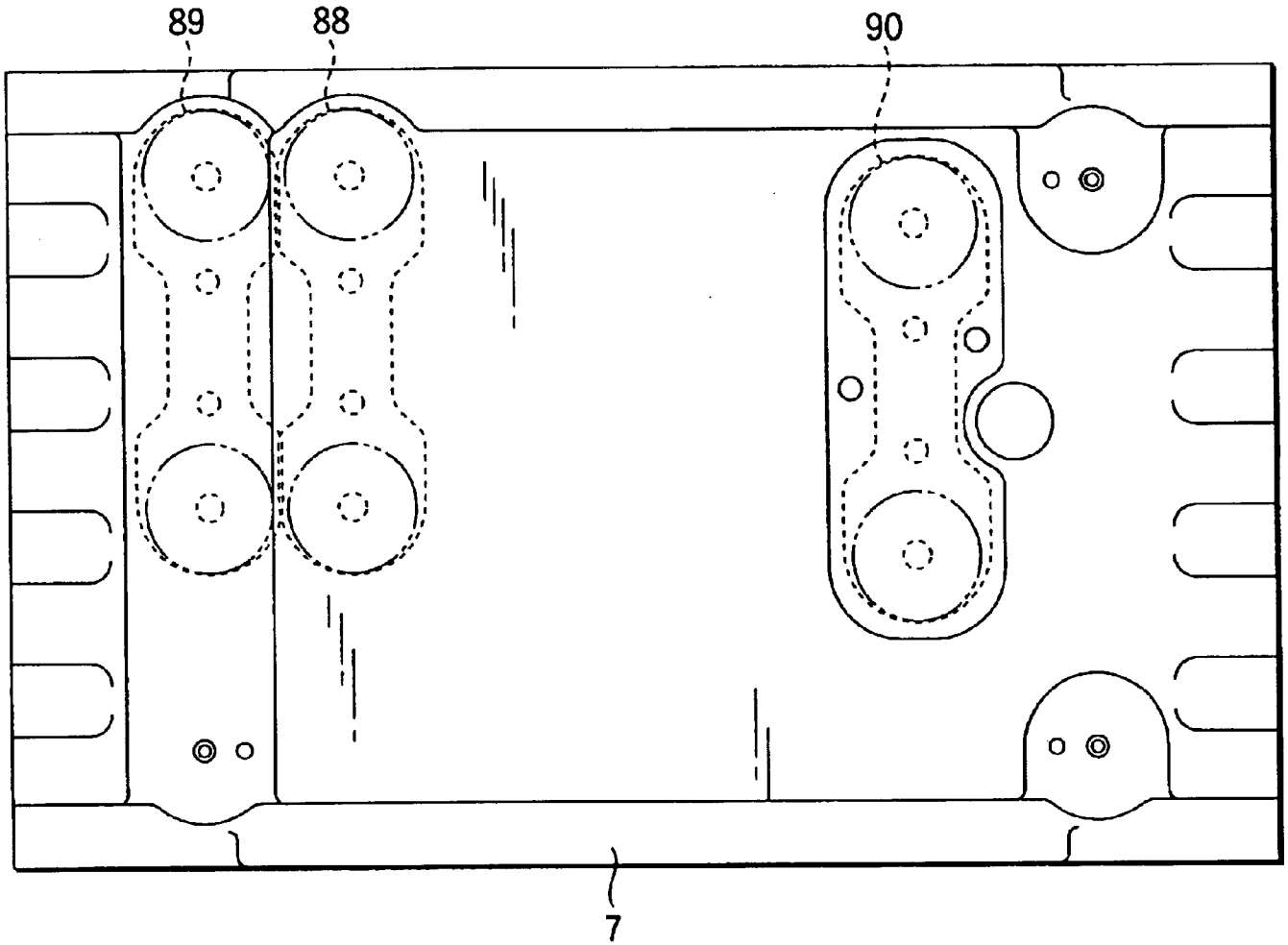
FIG. 7 is a bottom view showing a seat.
Figure 8:
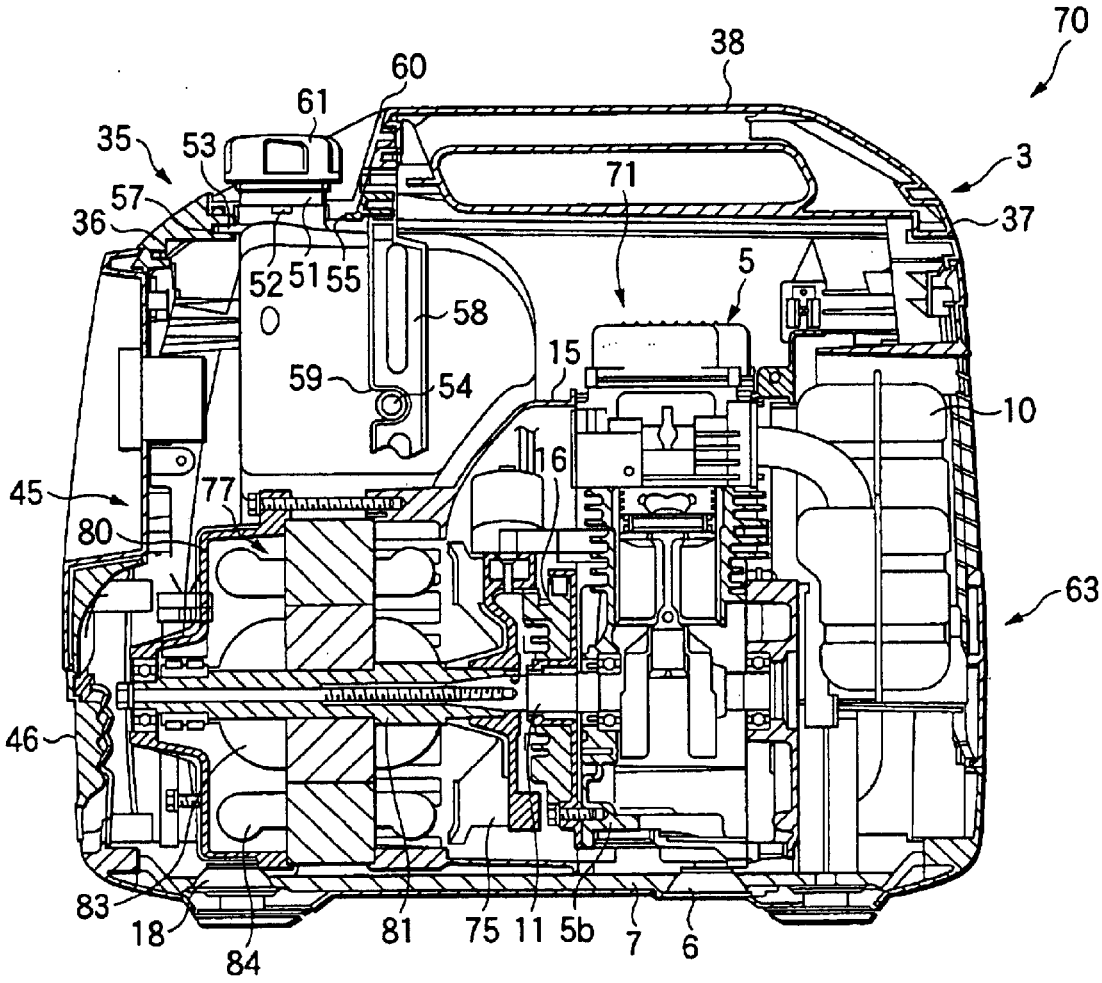
FIG. 8 is a longitudinal sectional view showing a soundproofed engine generator of the automatic voltage regulator type, when viewed from the right side.

The preferred embodiment of the present invention will be described with reference to the accompanying drawings. Drawings concern an embodiment of the present invention. FIG. 1 is a longitudinal sectional view showing a soundproofed engine generator of the inverter type when viewed from the right side. FIG. 2 is a cross sectional view taken on line I—I in FIG. 1. FIG. 3 is a front view showing an external appearance of the soundproofed engine generator. FIG. 4 is a right side view showing an external appearance of the soundproofed engine generator. FIG. 5 is a rear view showing an external appearance of the soundproofed engine generator. FIG. 6 is a top view showing a structure including a fuel tank mounting part in the soundproofed engine generator. FIG. 7 is a bottom view showing a seat. FIG. 8 is a longitudinal sectional view showing a soundproofed engine generator of the automatic voltage regulator type, when viewed from the right side.

A mechanism arrangement of a soundproofed engine generator 1 of the inverter type will first be described. As shown in FIG. 1, the soundproofed engine generator 1 is constructed with an engine generator 2 of the inverter type, and a soundproof cover 3 for housing the engine generator 2.

The engine generator 2 contains an engine 5 contains a forcedly air-cooled single cylinder engine 5. The engine 5 is fastened onto an engine support part 90 (see FIG. 7), which is provided on a seat 7 at a place located closer to the rear side as longitudinally viewed, in a state that a vibration-proof rubber 6 is interposed therebetween. The engine 5 is vertically mounted on the seat 7. A muffler 10 is disposed on the rear side of the engine, and a crank shaft 11 is extended in the front part of the engine. The number of revolutions of the engine 5 is set at 4200 rpm, for example.

A cooling fan 17 is coupled to the front side of the engine 5, through a flywheel 16. A power generator body 13 of the inverter type is coupled to the front side of the cooling fan 17.

To be more specific, a fan cover 15 is fixed to the front side of the engine 5. The crank shaft 11 is disposed within the fan cover 15. The flywheel 16 constructed integral with the recoil starter is fastened to the crankshaft 11. The cooling fan 17 is fastened to the flywheel 16.

A power generator cover 19, a lower part of which is fixedly mounted on the seat 7 with a vibration-proof rubber 18 being interposed therebetween, is coupled to the front end of the fan cover 15. The power generator cover 19 is mounted on a power generator support part 88 (see FIG. 7) located on the seat 7 at a position closer to the front side as longitudinally viewed, while the vibration-proof rubber 18 is interposed therebetween. A cylindrical portion 20, which is disposed coaxial with the crankshaft 11, is provided on the inner surface of the power generator cover 19. A plurality of generator coils 21 stand erect on the cylindrical portion 20. Permanent magnets 22 are disposed around the generator coils 21, while being confronted with the generator coils 21. The permanent magnets 22 are coupled to the cooling fan 17, through an outer rotor 23. Further, as shown in FIG. 2, a plurality of cooling air intake ports 24 for introducing cooling air into the power generator cover 19 are bored in the front surface of the power generator cover 19.

The soundproof cover 3 includes a cover body 35. The cover body 35 is longitudinally segmented into a front cover part 36 and a rear cover part 37. The upper sides of those cover parts 36 and 37 are interconnected by a handle 38, which is used when the engine generator is carried. The lower sides of them are interconnected by the seat 7. Openings 40 used for the access for maintenance are formed in the right and left sides of the cover body 35 (see FIG. 2). Those openings 40 are closed with side panels 41.

As shown in FIG. 3, a control board 45 is provided on the front surface of the front cover part 36. A cooling air intake port 46 is formed in a lower part of the control board 45. As shown in FIG. 1, an inverter unit 47 is fixed opposed to the cooling air intake port 46 within the front cover part 36. The inverter unit 47 is electrically connected to the control board 45 through a control wire 48, and to the power generator body 13 through a control wire 49. As shown, the inverter unit 47 is opposed to the power generator body 13 at a position just upstream of the power generator body.

Within the front cover part 36, a fuel tank 50 is mounted above the cooling fan 17 and the power generator body 13.

More specifically, as shown in FIGS. 1, 2 and 6, a cylindrical, fuel supply port 51 is protruded at a position closer to the front on the upper surface of the fuel tank 50. On the peripheral part of the fuel supply port 51, collar parts 52 protruding to the right and left sides are provided at positions separated from the upper surface of the fuel tank 50 by a distance substantially equal to a thickness of the front cover part 36. A protruding piece 53 protruding forward is provided at a position lower than the collar parts 52. Cylindrical protruding parts 54 are provided on the right and left surfaces of the fuel tank 50.

An elongated hole 55 having a width substantially equal to the diameter of the fuel supply port 51 is formed in the upper surface of the front cover part 36. Cutout parts 56 are formed in the elongated hole 55 at positions closer to the rear side thereof, while corresponding in position to the collar parts 52. A part of the front cover part 36, located in front of the elongated hole 55, is thick, and an engaging hole 57 for receiving the protruding piece 53 is formed in this thick part of the front cover part. Beams 58 are provided on and along the inner surface of the right and left sides of the front cover part 36, respectively. The beams 58 are provided with latching parts 59 capable of latching the cylindrical protruding parts 54 from the front side.

To mount the front cover part 36 to the fuel tank 50, a worker first positions the collar parts 52 to the cutout parts 56, and in this state, inserts the fuel supply port 51 into the elongated hole 55 in the front cover part 36. Then, he slides the fuel supply port 51 along the elongated hole 55, from the insertion position toward the front as viewed in the longitudinal direction. Subsequently, he inserts the peripheral part of the elongated hole 55 to between the upper surface of the fuel tank 50 and the collar parts 52, and fits the protruding piece 53 into the engaging hole 57. In this way, the upper part of the fuel tank 50 is supported by the front cover part 36 with the aid of the fuel supply port 51. Further, the worker applies the cylindrical protruding parts 54 to the latching parts 59, from the front side. As a result, the side of the fuel tank 50 is supported by the front cover part 36.

In FIG. 1, reference numeral 60 designates a rubber cover 60 which closes the gap by the elongated hole 55 after the fuel tank 50 is mounted onto the front cover part 36. Reference numeral 61 is a fuel cap to be put on the fuel supply port 51.

As shown in FIGS. 1 and 5, a cooling air exhaust port 63 is formed in the rear surface of the rear cover part 37 at a position opposed to the muffler 10.

A soundproofed engine generator 70 of the automatic voltage regulator (AVR) type will be described with reference to FIG. 8. In FIG. 8, parts designated by like reference numerals, which were used for explaining the inverter controlled soundproofed engine generator 1 already described, are used in common for both the soundproofed engine generators 1 and 70. Hence, no further description of them will be given. In the soundproofed engine generator 70 of the AVR type, a number of revolutions of the engine 5 is controlled to be 3000 rpm or 3600 rpm.

In the engine generator 71 of the AVR type housed in the soundproof cover 3, a cooling fan 75 is coupled to the front side of the engine 5, through the flywheel 16. A power generator body 77 of the AVR type is coupled to the front side of the cooling fan 75.

To be more specific, a fan cover 15 is fixedly mounted on the front side of the engine 5. A crank shaft 11 is disposed within the fan cover 15. A flywheel 16 constructed integral with the recoil starter is fixedly mounted on the crank shaft 11. The cooling fan 75 is fixedly mounted on the flywheel 16.

A power generator cover 80, a lower part of which is fixedly mounted on the seat 7 with a vibration-proof rubber 18 being interposed therebetween, is coupled to the front end of the fan cover 15. The power generator cover 80 is mounted on a power generator support part 89 (see FIG. 7) located on the seat 7 in a front part of the power generator support part 88, while the vibration-proof rubber 18 is interposed therebetween. A diameter of the power generator cover 80 of the AVR type is equal to that of the power generator body 13 of the inverter type. Accordingly, any of those power generator covers may be coupled to the fan cover 15, selectively.

Within the power generator cover 80, a shaft 81 is coupled to the crank shaft 11. A primary coil 83 is provided on the peripheral part of the shaft 81. A secondary coil 84 is provided on the inner peripheral parts of the fan cover 15 and the power generator cover 80, and is confronted with the primary coil 83.

In the embodiment, the power generator body 77 is disposed in a space where the inverter unit 47 and the power generator body 13 are located. Therefore, the long and large power generator body 77 may be housed within the same soundproof cover 3 as that of the soundproofed engine generator 1 of the inverter type. Thus, in each of the soundproofed engine generators 1 and 70, the position at which the power generator body 13 (77) is coupled to the crank shaft 11 is located at the end part on the crank shaft 11. In the soundproofed engine generator 1 of the inverter type, the inverter unit 47 is opposed to the power generator body 13 at a position just upstream of the power generator body. Accordingly, when the inverter unit and the power generator body 13 are removed, a continuous long and large space for receiving the power generator body 77 can be secured within the soundproof cover 3.

The power generator body 77 of the AVR type is longer and larger than of the power generator body 13 of the inverter type. Accordingly, it is preferable to dispose the vibration-proof rubber 18, which is used for fixedly mounting the power generator cover 80 onto the seat 7, at a position closer to a front part on the seat 7. In the embodiment, as shown in FIG. 7, the two power generator support parts 88 and 89 corresponding to the power-generating bodies 13 and 77 of the inverter type and the AVR type are provided before and after the seat 7. Further, the power generator covers 19 and 80 of the generator types may be mounted on the power generator support parts 88 and 89, with the vibration-proof rubber 18 being interposed therebetween. Accordingly, the power-generating bodies 13 and 77 may be supported on the seat 7 at proper positions.

Accordingly, the soundproofed engine generator 1 of the inverter type or the soundproofed engine generator 70 of the AVR type can be constructed without great altering of the generator construction, by commonization many generator parts such as the soundproof cover 3, and those generators 1 and 70 can be produced at low cost.

As seen from the foregoing description, the soundproofed engine generator of the inverter type or the soundproofed engine generator of the AVR type can selectively be constructed without great altering of the generator construction.

The disclosure of Japanese Patent Application No. 2001-314318 filed on Oct. 11, 2001 including the specification, drawings and abstract is incorporated herein by reference in its entirety.

What is claimed is:

1. A soundproofed engine generator comprising:

an engine generator in which a power generator body of an inverter type or a power generator body of an automatic voltage regulating type is selectively coupled to a crank shaft of an engine at a coupling position located at an end part on the crank shaft; and a soundproof cover having a space accommodating the engine generator and an inverter unit.

2. The soundproofed engine generator according to claim 1, further comprising:

a seat for supporting the engine generator, wherein the seat attaches to a power generator support part for the inverter type or the automatic regulator type.

3. A soundproofed engine generator comprising:

an engine having a crank shaft;

a power generator body selectively coupled at a coupling position located at an end part of the crank shaft, the power generator body being an inverter type or an automatic voltage regulating (AVR) type; and a soundproof cover having a space for accommodating at least either the power generator body of the inverter type and an inverter unit or the power generator body of the AVR type.

4. The soundproofed engine generator according to claim 3, further comprising:

a seat for vertically supporting the engine, wherein the seat attaches to a power generator support part for the inverter type or the automatic regulator type.

5. The soundproofed engine generator according to claim 3, further comprising:

a flywheel coupled to the engine; and a cooling fan attached to flywheel and coupled to the power generator body.

6. The soundproofed engine generator according to claim 3, further comprising:

a flywheel attached to the crank shaft;

a cooling fan attached to the flywheel; and a fan cover disposed on the engine to house the cooling fan, the flywheel, and the crank shaft between the engine and the cover.

7. The soundproofed engine generator according to claim 6, further comprising:

a seat for vertically mounting the engine;

a power generator cover coupled to the seat and coupled to the fan cover; and a vibration-proof rubber disposed between the seat and the power generator cover.

8. The soundproofed engine generator according to claim 6, further comprising:

a seat for vertically mounting the engine;

a power generator cover coupled to the seat and coupled to the fan cover; and a vibration-proof rubber disposed between the seat and the power generator cover, wherein the power generator body is contained within the power generator cover, and the power generator cover has the same diameter for either the power generator body of the inverter type or power generator body of the AVR type.

9. The soundproofed engine generator according to claim 3, wherein the power generator body of the AVR type would occupy a space where the power generator body of the inverter type and the inverter unit would be, the inverter unit being disposed in front of the power generator body, thereby ensuring that the soundproof cover of the same dimension can be used with the power generator body of either the AVR type or the inverter type.

10. The soundproofed engine generator according to claim 3, wherein the soundproof cover comprises:

a cover body;

a handle attached to an upper side of the cover body;

a seat attached to lower sides of the cover body;

a cooling air intake port on a front side of the cover body; and a cooling air exhaust port on a back side of the cover body, wherein the cover body has closable openings at right and left sides for access for maintenance, and the cooling air intake port is disposed opposite to the inverter unit.

11. The soundproofed engine generator according to claim 3, wherein the power generator body of the AVR type comprises:

a shaft horizontally coupled to the crank shaft;

a primary coil peripherally disposed about the shaft; and a secondary coil disposed to confront the primary coil.

12. A soundproofed engine generator comprising:

an engine having a crank shaft;

a power generator body coupled to an end part of the crank shaft, the power generator body being an inverter type or an automatic voltage regulating (AVR) type; and a soundproof cover having a space for accommodating at least the power generator body of the inverter type and an inverter unit or the power generator body of the AVR type, wherein the power generator body of the AVR type would occupy a space where the power generator body of the inverter type and the inverter unit would be, the inverter unit being disposed in front of the power generator body, thereby ensuring that the soundproof cover of the same dimension can be used with the power generator body of either the AVR type or the inverter type.

13. The soundproofed engine generator according to claim 12, further comprising:

a seat for vertically supporting the engine, wherein the seat attaches to a power generator support part for the inverter type or the automatic regulator type.

14. The soundproofed engine generator according to claim 12, further comprising:

a flywheel coupled to the engine; and a cooling fan coupled to flywheel and coupled to the power generator body.

15. The soundproofed engine generator according to claim 12, further comprising:

a flywheel attached to the crank shaft;

a cooling fan attached to the flywheel; and a fan cover disposed on the engine to house the cooling fan, the flywheel, and the crank shaft between the engine and the fan cover.

16. The soundproofed engine generator according to claim 15, further comprising:

a seat for vertically mounting the engine;

a power generator cover coupled to the seat and coupled to the fan cover; and a vibration-proof rubber disposed between the seat and the power generator cover.

17. The soundproofed engine generator according to claim 15, further comprising:

a seat for vertically mounting the engine;

a power generator cover coupled to the seat and coupled to the fan cover; and a vibration-proof rubber disposed between the seat and the power generator cover, wherein the power generator body is contained within the power generator cover, and the power generator cover has the same diameter for either the power generator body of the inverter type or the power generator body of the AVR type.

18. The soundproofed engine generator according to claim 12, wherein the soundproof cover comprises:

a cover body;

a handle attached to an upper side of the cover body;

a seat attached to lower sides of the cover body;

a cooling air intake port on a front side of the cover body; and a cooling air exhaust port on a back side of the cover body, wherein the cover body has closable openings at right and left sides for access for maintenance, and the cooling air intake port is disposed opposite to the inverter unit.

19. The soundproofed engine generator according to claim 12, wherein the power generator body of the AVR type comprises:

a shaft horizontally coupled to the crank shaft;

a primary coil peripherally disposed about the shaft; and a secondary coil disposed to confront the primary coil.

* * * * *